US007629097B2

(12) United States Patent
Molaire

(10) Patent No.: US 7,629,097 B2
(45) Date of Patent: Dec. 8, 2009

(54) ENCAPSULATED TONER COMPOSITIONS INCORPORATING ORGANIC MONOMERIC GLASSES

(75) Inventor: Michel F. Molaire, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 374 days.

(21) Appl. No.: 11/453,408

(22) Filed: Jun. 15, 2006

(65) Prior Publication Data

US 2007/0292799 A1 Dec. 20, 2007

(51) Int. Cl.
*G03G 9/087* (2006.01)
*G03G 9/093* (2006.01)

(52) U.S. Cl. ..... 430/108.21; 430/110.2

(58) Field of Classification Search ..... 430/108.21, 430/110.2
See application file for complete search history.

(56) References Cited

U.S. PATENT DOCUMENTS

| | | | | |
|---|---|---|---|---|
| 3,974,078 | A | 8/1976 | Crystal | |
| 4,148,741 | A | 4/1979 | Bayley | |
| 4,656,111 | A | 4/1987 | Wakamiya et al. | |
| 4,766,051 | A | 8/1988 | Breton et al. | |
| 4,851,318 | A | 7/1989 | Hsieh et al. | |
| 5,385,799 | A * | 1/1995 | Ono et al. | 430/108.21 |
| 5,635,325 | A | 6/1997 | Inaba et al. | |
| 6,177,223 | B1 * | 1/2001 | Hashimoto et al. | 430/110.1 |
| 2001/0041260 | A1 | 11/2001 | Azizi et al. | |
| 2004/0248026 | A1 * | 12/2004 | Ueno et al. | 430/108.2 |

FOREIGN PATENT DOCUMENTS

| | | |
|---|---|---|
| GB | 1 319 815 | 6/1973 |

* cited by examiner

*Primary Examiner*—Hoa V Le
(74) *Attorney, Agent, or Firm*—Carl F. Ruoff; Andrew J. Anderson

(57) ABSTRACT

The present invention is an electrostatographic core shell toner which includes as a core material of at least two non-polymeric compounds each independently corresponding to the structure $(R^1Y^1)_p[(Z^1Y^2)_mR^2Y^3]_nZ^2Y^4R^3$. M is zero or one, n is zero up to an integer at which said compound starts to become a polymer and p is an integer of from one to eight. Each of $R^1$ and $R^3$ is independently a monovalent aliphatic or cycloaliphatic hydrocarbon group an aromatic group or a multicyclic aromatic nucleus. Each of $R^2$, $Z^1$ and $Z^2$ independently represent multivalent aliphatic or cycloaliphatic hydrocarbon groups or an aromatic group. $Y^1$, $Y^2$, $Y^3$ and $Y^4$ each independently represent one or more linking groups. The core material is surrounded by a shell that includes an amorphous matrix.

9 Claims, No Drawings

ENCAPSULATED TONER COMPOSITIONS INCORPORATING ORGANIC MONOMERIC GLASSES

FIELD OF THE INVENTION

This invention relates generally to toners and toner compositions for use in electrostatic imaging systems, and more specifically to encapsulated toner compositions having a core and a shell, incorporating amorphous monomeric glasses in the core material.

BACKGROUND OF THE INVENTION

In an electrophotographic device or electrostatic recording device, an electrostatic latent image is formed on a photoconductor, to which toner is attracted. The toner is transferred to a support material, such as a piece of paper, and then fused to the support material by heat and thus a toner image is formed. There has been increasing demand to reduce energy consumption. As users' printing demands increase, printers are required to print at higher speeds, the toner must be heat/pressure fused to the paper in ever shortening times. A solution is to use toner with lower melting temperature to overcome this problem. However lower melting temperature toners suffer from a blocking problem. They tend to fuse together during storage at typical environmental conditions. Encapsulated or core-shell toners were developed to deal with that problem. The term "core/shell toner" refers to a toner powder comprising a core material, typically a wax, to act as a release agent, and a shell coating that includes a binder and the colorant for the toner particle.

Another benefit of encapsulated toners is to passivate the pigment charging, that is the charging characteristics of the toner particles is ultimately controlled by that of the colorants, especially those exposed at the surfaces of the toner particles. Influence of the pigment charging can be prevented by encapsulation of various color particles with a common shell polymer of the desired charging properties. Therefore, developer charging, including triboelectric and admix characteristics, can be controlled and pre-selected.

The preparation of encapsulated toners was first suggested in British Patent 1,319,815. The method of the British patent comprises preparing a kneaded oil phase component made up of one or more liquid resin monomers, coloring material, the polymerization initiator and a finely-divided inorganic dispersion stabilizer such as a metal powder or inorganic salt or oxide and a polar resinous additive which is soluble in a monomer. After suspension polymerization of the monomer, if required, the finely divided dispersion stabilizer is removed by dissolution in an acid and the polymer particles are removed from the aqueous phase and dried to produce toner.

It has also been proposed that a suspension polymerization process similar to the above referenced British Patent but not making use of an inorganic stabilizer be carried out to produce an encapsulated toner. This process is performed generally be mixing a monomer, a colorant and an initiator to form an oil soluble organic phase; dispersing this oil soluble phase in controlled size between 5 to 20 microns in a water phase, employing a suspending agent, for example polyvinyl alcohol; polymerizing, employing conventional suspension polymerization techniques; introducing a second monomer which is allowed to diffuse into the first polymer and consequently swells the polymer; introducing a water soluble initiator; and heating this reaction mixture to effect a polymerization of the second monomer and form the desired toner. It is found that the second initiator, the water soluble initiator, generates a free radical which attacks the surface of the swollen polymer particle and promotes polymerization at the surface by reacting with monomer at the surface thereby decreasing the monomer concentration and causing the transport of monomer to the surface by diffusion. The process is found to be self-terminating when the total amount of absorbed monomer has been converted to polymer at the surface, thus providing an encapsulated toner.

In U.S. Pat. No. 3,974,078 Crystal disclosed an encapsulated toner making process, by providing an electrostatographic toner of the colored resinous material in which at least a major portion of the resinous material is a heterogeneous (two phase) physical mixture comprised of at least one soft deformable polymer dispersed and encapsulated in a matrix of at least one tough polymer, as a plurality of discrete domains, instead of as a single core.

More particularly, the resinous portion of the toner includes two incompatible polymers one of which is employed as a matrix and the other of which is dispersed in a plurality of discrete domains and encapsulated in the matrix. The matrix component is a tough material to provide the physical properties which prevents blocking of and provides structural rigidity to the toner, and the dispersed component, is a soft material which provides the desired fixing properties. In the use of such a two-phase resin system, it has been found that the softer material must be completely encapsulated within the tough matrix material, and in addition, it has been found that the manner in which the softer component(s) is dispersed within the matrix influences the properties of the toner. The dispersion of the encapsulated softer component(s) as a plurality of domains of controlled size, results in an improved toner; in particular, a toner which is capable of being fixed by the application of pressure.

The toner of U.S. Pat. No. 3,974,078, in general, the tough polymer, which is employed as a matrix, has a glass transition temperature (Tg) of greater than about 50° C., preferably from about 55 to about 180° C., and more preferably from about 60 to about 90° C. If the polymer is crystalline, then the melting temperature (Tm) is greater than about 40° C., preferably from about 50 to about 90° C. and more preferably from about 60 to about 70° C. Thus, if the tough polymer is crystalline, the Tm must be greater than about 40° C. The molecular weight (number average) of the tough polymer block is greater than 1500, generally from about 5,000 to about 300,000, and preferably from about 10,000 to about 100,000.

In U.S. Pat. No. 4,148,741, Bayley disclosed a polymerization and attrition method for producing toner with reduced processing steps. In U.S. Pat. No. 4,148,741, Bayley identified that in formation of toner by known processes such as emulsion polymerization, spray drying or attrition from bulk, the problem of elements on the surface of the particle acting in a hydrophilic manner remains. Elements such as exposed pigment reactive groups, solvent or reactive monomers may attract water molecules and contribute to blocking of the toner and changes in triboelectric properties. Thus, U.S. Pat. No. 4,148,741 disclosed ways to produce encapsulated toners of high resistance to blocking, with minimized humidity sensitivity, low manufacturing cost and fewer steps.

Encapsulated, and cold pressure fixable toner compositions are known. Cold pressure fixable toners have a number of advantages as compared to toners that are fused by heat, primarily relating to the requirements for less energy since these toner compositions can be fused at room temperature. Nevertheless, many of the prior art cold pressure fixable toner compositions suffer from a number of deficiencies. For example, these toner compositions must usually be fused under high pressure, which has a tendency to severely disrupt the fusing characteristics of the toner selected. This can result in images of low resolution, or no images whatsoever. Also, with some of the prior art cold pressure toner compositions substantial image smearing can result from the high pressures required and from the use of plasticizer type materials in large quantities. Additionally, the cold pressure fixing toner compositions of the prior art have other disadvantages in that, for example, these compositions when used for development cause in some instances images with high gloss that are of low crease resistance. Furthermore, the images resulting exhibit an undesirable carbon paper effect, thus there is a total or partial image transfer from the image substrate to neighboring substrates caused by pressures arising from normal handling.

Wakamiya, et al. in U.S. Pat. No. 4,656,111 disclosed a pressure-fixable toner comprising a combination of a compound A having a hydrocarbon chain and a compound B having an amino group in addition to a hydrocarbon chain is excellent in dispersibility of colorant, pressure fixing characteristic and developing characteristic. Further, an encapsulated pressure-fixable toner comprising a core of the pressure-fixable toner particles and a shell encapsulating the core is also excellent in these properties.

A characteristic feature of the toner of U.S. Pat. No. 4,656,111 is that it has a particularly excellent dispersibility of a pigment, as compared with the toner of the prior art. This is because the compound B having a hydrocarbon chain and an amino group has an extremely good compatibility with a compound having a hydrocarbon chain and also has good affinity for a pigment. Thus, dispersion can be effected easily even in the combination of a pigment and a compound having a hydrocarbon chain in which the pigment can be poorly dispersed in the prior art. While the improvement may be attributable to improved dispersion of the pigment, the toner of U.S. Pat. No. 4,656,111 is excellent in mechanical strength, satisfactory in pressure fixing characteristic and sufficient in developing characteristic, with the change in developing characteristic being small even when used for a large number of times. The fixing characteristic is also excellent and does not change depending on the speed, paper quality, etc.

Breton, et al. in U.S. Pat. No. 4,766,051 described a cold pressure fixable colored toner composition comprised of a core containing a polymer in which is dispersed pigment particles selected from the group consisting of cyan, magenta, red, yellow pigments, and mixtures thereof, other than carbon blacks and magnetites; and encapsulated within a polymeric shell formulated by an interfacial polymerization.

The advantages of U.S. Pat. No. 4,766,051 include:

cold pressure fixable toner compositions with hard shells formulated by an interfacial polymerization process;

encapsulated toners with colored newsprint inks containing polymers, and economical pigments therein;

economical processes for the preparation of colored encapsulated toners by interfacial polymerization processes; and encapsulated toners with compatible color oil soluble dyes, which can be trapped within block copolymer domains, and wherein the block copolymer micro domains are "mini-reservoirs" of ink, like material.

Hsieh, et al. in U.S. Pat. No. 4,851,318 disclosed an improved process for the preparation of encapsulated toner compositions which comprises mixing core monomer(s), an initiator, or initiators, pigment particles, and oil soluble shell monomer(s); homogenizing the aforementioned mixture into an aqueous surfactant solution resulting in an oil-in-water suspension; thereafter adding water soluble shell monomer(s) to the oil-in-water suspension enabling an interfacial polymerization reaction between the oil soluble and the water soluble shell monomer(s); subsequently adding a low molecular weight polyethylene oxide surfactant protective colloid; and thereafter affecting a free-radical polymerization of the core monomer(s) by heating.

U.S. Pat. No. 4,851,318 teaches processes for encapsulated toner compositions comprised of a core containing a pigment particles, and a polymerizable monomer, or monomers, such as free-radical polymerizable monomer, or monomers; a polymerization initiator or initiators; and a shell generated by interfacial polymerization processes. More specifically, the process of U.S. Pat. No. 4,851,318 comprises (1) mixing a blend of a core monomer, or monomers, preferably not exceeding five, initiator, pigment particles, and oil soluble shell monomer(s); (2) forming an oil-in-water suspension by homogenization of the aforementioned mixture and an aqueous surfactant solution; (3) subsequently subjecting the aforementioned suspension to an interfacial polymerization by addition of a water soluble shell monomer, or monomers. After the polymerization is complete, (4) there is added to the suspension a low molecular weight polyethylene oxide surfactant as a protective colloid. Free-radical polymerization (5) is initiated by heating the suspension, for example, to 75° C., thus commencing the free-radical polymerization of the core monomer, or core monomers.

The benefits of encapsulated toners include the separation of functionality for core and shell. The shell enables mechanical robustness, anti blocking properties (thermal stability), uniform tribo charging for different colors (eliminates pigments, waxes, etc from the toner surface), good powder flow. The core enables lower fusing temperatures, release from fuser (wax in core), color properties.

However there are still some drawbacks with encapsulated toners that require solution. Incompatibility of the shell and core results in low gloss, low transparency; and non-uniform coverage of the shell.

Azizi et al in U.S. Published Patent Application 2001/0041260 disclosed a high clarity image bearing sheet, designed specifically to correct the drawback of encapsulated toners. Azizi et al provide a recording sheet including an additive, referred to herein as a compatibilizer, to improve the quality of images formed by toner powder development of electrostatic charge patterns. Recording sheets, carrying images produced by toner powder transfer and fusion on a receptor surface, according to the present invention, exhibit improved light transmission and reduced light scattering. Specifically, a transparent sheet is provided having a toner-receptive coating containing about 4 wt. % to about 25-wt % of a compatibilizer on at least one surface, wherein the coating has a low-density yellow Q factor value at least 2 less than an identical coating without the compatibilizer. Azizi et al is particularly effective in systems using core/shell toners where the core and the shell form an immiscible heterogeneous blend after fusing, with high levels of light scatter.

Toners used in a full-color copying apparatus are required to show a good color reproducibility and also sufficient color-mixing characteristic among the respective colors in a hot-pressure fixing step without impairing a clarity required for overhead projector (OHP) images. Compared with a black toner for ordinary monochromatic copying apparatus, a toner for full-color image formation preferably comprises a low-molecular weight binder resin having a sharp-melting characteristic. However, an ordinary sharp-melting binder resin shows only a low self-cohesion so that it is liable to cause a problem in anti-high-temperature offset characteristic when the toner is melted in a hot-pressure fixing step. In an ordinary black toner for monochromatic copying apparatus, a wax component having a relatively high crystallinity as represented by polyethylene wax or polypropylene wax is used as a release agent. However, in a toner for full-color image formation, because of a high crystallinity of the release agent per se or a difference in refractive index from an OHP sheet, the clarity of a projected image is impaired to result in projected images having low saturation and brightness.

Inaba, et al. in U.S. Pat. No. 5,635,325 disclosed a toner for developing electrostatic images includes: at least a binder resin, a colorant and an ester wax. The ester wax is contained in 3-40 wt. parts per 100 wt. parts of the binder resin. The ester wax includes ester compounds represented by a formula of $R_1$—COO—$R_2$, wherein $R_1$ an $R_2$ independently denote a hydrocarbon group of 15-45 carbon atoms. The ester wax contains 50-95 wt. % thereof of ester compounds having an identical number of total carbon atoms. The toner is especially characterized by low-temperature fixability, wide non-offset temperature range, good color mixing characteristic and transparency.

There is a need to provide encapsulated toners that provide all the advantages mentioned above while providing images with brilliant color and high clarity, without the need for specialized substrates.

There are specific needs to provide encapsulated toners without blocking problem, with low temperature fusing, and yet where the core and shell materials are fully compatibilized on the receiver sheets, without the need for specialized receivers.

The present invention provides a solution to the above mentioned problems.

It is an object of this invention to provide encapsulated toner compositions with many of the advantages illustrated herein.

It is also an object of this invention to provide toner compositions that can be made by virtually all the known fabrication methods.

In another object of this invention there are provided encapsulated toner compositions comprised of a core of resin binder, pigments/and or dyes surrounded by a polyester shell, whereas the core material incorporate a percentage of organic monomeric glasses sufficient to render the core and shell materials fully compatible once the electrophotographic printing process is completed.

A further object of the present invention is to provide heat fixable microcapsule toner compositions, which offer low flow characteristics.

An additional object of the present invention is to provide encapsulated color and black toner compositions that offer excellent image quality such as high fix, high resolution, high gloss, high color chroma, high transparency projection efficiency and other desirable color toner characteristics.

In another object of the present invention there are provided developer compositions formulated by admixing carrier particles with the toner compositions obtained by the processes illustrated herein.

Further, another object of the present invention is the provision of microcapsule toners with excellent surface release and powder flow properties without surface additives such as Aerosols.

Further embodiments of the present invention include a process for the preparation of encapsulated toner compositions which comprises a core component comprising an organic monomeric glass composition with tailored properties to maintain low melting, good transfer, with the additional benefits of compatibilizing the final printed toner material on the substrate to provide brilliant and transparent colors without scattering.

SUMMARY OF THE INVENTION

The present invention is an electrostatographic core shell toner which includes as a core material of at least two non-polymeric compounds each independently corresponding to the structure $(R^1Y^1)_p[(Z^1Y^2)_mR^2Y^3]_nZ^2Y^4R^3$. In this structure m is zero or one, n is the number of recurring units in the compound, and is zero up to, but not including, an integer at which said compound starts to become a polymer and p is an integer of from one to eight. Each of $R^1$ and $R^3$ is independently a monovalent aliphatic or cycloaliphatic hydrocarbon group having 1 to 20 carbon atoms, an aromatic group or a multicyclic aromatic nucleus. Each of $R^2$, $Z^1$ and $Z^2$ independently represent multivalent aliphatic or cycloaliphatic hydrocarbon groups having 1 to 20 carbon atoms or an aromatic group. $Y^1$, $Y^2$, $Y^3$ and $Y^4$ each independently represent one or more linking groups. The core material is surrounded by a shell that includes an amorphous matrix, having a glass transition temperature (Tg) of greater than about 50° C.

DETAILED DESCRIPTION OF THE INVENTION

Organic monomeric glasses provide unique properties for the present invention. They are easily made with tailored glass transition temperature Tg. Because they are non-crystalline and non polymeric they possess very low melt viscosity a few degrees above Tg, and thus, they can be formulated at higher Tg than polymeric and oligomeric materials. This property presents the advantage of effectively preventing blocking, while providing low viscosity at relatively low fusing temperature.

The most important property of monomeric glasses for the present invention is their high entropy of mixing. This property is inherent to the fact the monomeric glasses of this invention are complex mixtures of materials. This property makes them super-compatibilizing materials, more efficient than the liquid materials used in U.S. Published Patent Application 2001/0041260 for example.

An amorphous monomeric glass is defined as a mixture of compatible organic monomeric molecules with an infinitely low crystallization rate under the most favorable conditions. These mixtures can be formed in a one-part reaction of a multifunctional nucleus with a mixture of substituents. The "noncrystallizability" of the mixture is controlled by the structural dissymmetry of the nucleus and/or the substituents and the number of components making up the mixture. The organic monomeric glasses, like amorphous polymers, have good film-forming properties. However, unlike polymers, they display extremely low melt-viscosities and large positive entropy-of-mixing values and can be ground easily into extremely small particles. These properties make them ideal for certain applications where compatibility, melt-flow, and small particle size are important. The encapsulated core/shell toners of this invention use monomeric glasses in the core composition to both provide low fusing temperature without blocking problems and a fully compatible imaged and fused toner on the receiver materials providing vibrant, transparent color.

The monomeric glasses of this invention are prepared according to the technique described in M. F. Molaire and Roger Johnson in "Organic Monomeric Glasses: A Novel Class of Materials," Journal Polymer Science, Part A, Polymer Chemistry, Vol. 27, 2569-2592 (1989). These materials are used and described in U.S. Pat. No. 4,416,890 and U.S. Pat. No. 4,499,165 "Binder-Mixtures for optical Recording Layers and Elements" by Molaire. Their melt viscosity properties are demonstrated in "Influence of melt viscosity on the Writing Sensitivity of Organic dye-Binder Optical-Disk Recording Media," M. F. Molaire, Applied Optics, Vol. 27 page 743, Feb. 15, 1988.

Their use in electrographic applications is described in U.S. Pat. No. 4,473,626 by Molaire et Al "Electrohardenable materials for photoelectrophoretic imaging". In U.S. Pat. No. 5,176,977 Molaire & Alexandrovich, "Nonpolymeric amorphous developer compositions and developing process." They have been used to fabricate conventional dry powder toner.

In both U.S. Pat. Nos. 4,473,626 and 4,473,626 blocking and glass transition temperature properties were important and were satisfied.

The powdered toner and developer compositions of the present invention employ as the binder certain mixtures of compounds disclosed in U.S. Pat. No. 4,499,165 to Molaire, although that reference discloses the use of the mixtures in optical recording layers and elements. No suggestion is made of the amenability of the mixtures to pulverization into very small particles for use in toner and developer compositions. In U.S. Pat. No. 5,176,977 disclosed the use of these materials for conventional dry toners. No suggestion is made of their use in a core/shell toner as a compatibilizer of the core and shell materials.

Specifically, the nonpolymeric, amorphous mixtures of compounds useful as the binders of the toner and developer compositions of this invention are homogeneous mixtures of at least two nonpolymeric, thermoplastic compounds, each compound in the mixture independently conforming to the structure:

$$(R^1Y^1)_p[(Z^1Y^2)_mR^2Y^3]_nZ^2Y^4R^3$$

wherein m is zero or one; n is the number of recurring units in the compound, and is zero up to, but not including, an integer at which said compound starts to become a polymer; p is an integer of from one to eight; each $R^1$ and $R^3$ is independently a monovalent aliphatic or cycloaliphatic hydrocarbon group having 1 to 20 carbon atoms, an aromatic group or a multicyclic aromatic nucleus;

$R^2$, $Z^1$ and $Z^2$ each independently represent multivalent aliphatic or cycloaliphatic hydrocarbon groups having 1 to 20 carbon atoms or an aromatic group;

$Y^1$, $Y^2$, $Y^3$ and $Y^4$ each independently represents one or more linking groups such as esters (—COO—), amides (—CONH—), urethanes (—NHCOO—), imides

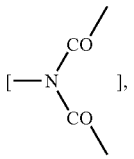

nitrilomethyleneoxys

-continued

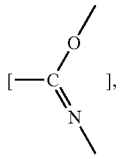

nitrilomethyleneiminos

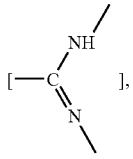

nitrilomethylenethios

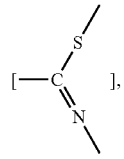

1,2,4-triazol-2,5-ylenes

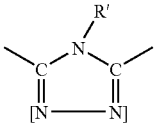

wherein R' represents alkyl of 1-6 carbon atoms, hydroxyl, amino or aryl such as phenyl, and 1,3,4-oxadiazol-2,5-ylenes

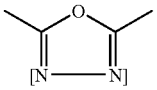

provided that at least one of $R^1$, $Z^1$, $R^2$, $R^3$ and $Z^2$ is an aromatic group and the glass transition temperature (Tg) of the mixture ranges from 50 to 120° C.

In the structural formula, the expression "$[(Z^1Y^2)_mR^2Y^3]_n$" describes nonpolymeric compounds which are oligomers. Oligomers are usually formed when either $Z^1$ or $R^2$ are at least bivalent. The $(Z^1Y^2)_m$ moiety describes oligomers in which $Z^1$ repeats itself such as when $Z^1$ is derived from p-hydroxybenzoic acid. When n is one or more, p in the structural formula is preferably one to avoid significant crosslinking of the compound due to the multivalent nature of $Z^1$. However, some crosslinking can be tolerated in binder-mixtures for toner and developer compositions.

In general, the Tg of the binder is high enough to provide suitable storage stability, yet low enough to allow low temperature fusing and extended fusing latitude. In one preferred embodiment of the invention, the Tg of the mixture ranges from 55 to 80° C.

A "multicyclic aromatic nucleus" is a nucleus comprising at least two cyclic groups at least one of which is aromatic, including aromatic heterocyclic ring groups. The cyclic group may be substituted with substituents such as aliphatic hydrocarbons, including cycloaliphatic hydrocarbons, other aromatic ring groups such as aryl, and heterocyclic ring groups such as substituted or fused thiazole, oxazole, imide, pyrazole, triazole, oxadiazole, pyridine, pyrimidine, pyrazine, triazine, tetrazine and quinoline groups. The substituents are fused or non-fused and mono or polycyclic. Examples of multicyclic aromatic nuclei include 9,9-bis(4-hydroxy-3,5-dichlorophenyl)fluorene, 4,4'-hexahydro-4,7-methanoindan-5-ylidenebis(2,6-dichlorophenol); 9,9-bis(4-hydroxy-3,5-dibromophenyl)fluorene, 4,4'-hexahydro-4,7-methanoindan-5-ylidenebis(2,6-dibromophenol); 3',3",5',5"-tetrabromophenolphthalein, 9,9-bis(4-aminophenyl) fluorene, phenylindandiols; 1,1'-spirobiindandiols, 1,1'-spirobiindandiamines, 2,2'-spirobichromans; 7,7-dimethyl-7H-dibenzo[c,h]xanthenediol; xanthylium salt diols; 9,9-dimethylxanthene-3,6-bis(oxyacetic acids); 4,4'(3-phenyl-1-indanylidene)-diphenol and other bisphenols; 3',3"-dibromo-5',5"-dinitro-2',2"-oxaphenolphthalein; 9-phenyl-3-oxo-2,6,7-trihydroxyxanthene; and the like.

"Aliphatic hydrocarbon group" for $R^1$, $R^2$, $R^3$, $Z^1$ and $Z^2$ refers to monovalent or divalent, alkanes, alkenes, alkadienes and alkynes having from 1 to 20 carbon atoms. The groups are straight or branched chain and include carbohydrate, carboxylic acid, alcohol, ether, aldehyde and ketone functions. "Cycloaliphatic" refers to cyclic aliphatic hydrocarbon groups. The groups may be substituted with halogen, alkoxy, amide, nitro, ester and aromatic groups. Although the compounds in the mixture are non-polymeric, compounds which are oligomers are included in the mixtures. The nonpolymeric compounds in the mixtures of the invention are distinguished from polymers according to the following relationship.

The qualitative relationship between the log viscosity (log $\eta$) to the log molecular weight (log MW) of a compound is linear. At a critical molecular weight (MWc) or critical viscosity ($\eta_c$) the slope of a curve illustrating that relationship changes sharply, for example, from about 1 to about 3.4. Above MWc or $\eta_c$ the compound is polymeric. Below MWc or $\eta_c$, the compound is a monomer or an oligomer and is within the scope of this invention. MWc and $\eta_c$ is not fixed, and varies with the structure of the particular compound. See Fundamental Principles of Polymeric Materials for Practicing Engineers by Stephen L. Rosen, Barnes and Noble, Inc., New York, N.Y., (1971), pages 176 and 177. In general, it is believed that compounds having a molecular weight up to about 5000 or up to about 10 recurring units are useful in the mixtures of this invention, although it is expected that compounds having a molecular weight greater than 5000 or more than 10 recurring units will in some circumstances be operable.

In another embodiment of the invention, the nonpolymeric, amorphous mixtures of compounds useful as the binders of the toner compositions of this invention are homogenous mixtures of at least two nonpolymeric, thermoplastic compounds, each compound in the mixture independently conforming to the structure:

$$Z(Y—R)_n$$

wherein n is two to eight; Z is a straight or branched chain, substituted or unsubstituted aliphatic group optionally having hetero atom groups in or appended thereto, or a substituted or unsubstituted homo- or heterocyclic, mono- or polycyclic group;

each R group independently from the other R groups, is a straight or branched chain, substituted or unsubstituted aliphatic group optionally having hetero atom groups in or appended thereto, or a substituted or unsubstituted homo- or heterocyclic, mono- or polycyclic group;

each Y, which may be the same or different from the other Y groups, is an ester, amide, imide or urethane linkage joining the nucleus Z to an appended group R;

provided that at least one Z or R group is an aromatic group, the mixture comprises at least two different R groups and the Tg of the mixture ranges from 50 to 120° C.

For the nucleus Z, "aliphatic group" refers to divalent or multivalent alkanes, alkenes, alkadienes and alkynes having from 1 to 20 carbons. The groups are straight or branched chain and include carbohydrate, carboxylic acid, alcohol, ether, aldehyde and ketone functions. The groups may be substituted with halogen, alkoxy, amide, nitro, ester and aromatic groups. Monovalent versions of the same types of aliphatic groups are suitable R groups.

The term "amorphous" means that the mixture is noncrystalline. That is, the mixture has no molecular lattice structure.

Exemplary aliphatic groups include methyl, ethyl, propyl, isopropyl, butyl, hexyl, 2-ethylhexyl, methoxyethyl, ethoxycarbonylpropyl, 3-oxobutyl, 3-thiapentyl, furfuryl, 2-thiazolylmethyl, cyclohexylmethyl, benzyl, phenethyl, phenoxyethyl, vinyl (—CH═CH—), 2-methylvinyl, allyl, allylidene, butadienyl, butenylidene, propargyl, etc.

"Aromatic" and "aromatic heterocyclic" group refer to organic groups which undergo the same type of substitution reaction as benzene. In benzene, substitution reactions are preferred over addition reactions. Such groups preferably have from 6 to about 40 nuclear atoms and are mono- and polycyclic.

Exemplary aromatic groups include quinolinyl, pyrimidinyl, pyridyl, phenyl, tolyl, xylyl, naphthyl, anthryl, triptycenyl, p-chlorophenyl, p-nitrophenyl, p-bromophenyl, 2,4-dichlorophenyl, 2-chlorophenyl, 3,5-dinitrophenyl, p-(tetrabromophthalimido)phenyl, p-(tetrachlorophthalimido)phenyl, p-tetraphenylphthalimido)phenyl, p-naphthalimidophenyl, p-(4-nitrophthalimido)phenyl, p-phthalimidophenyl, 1-hydroxy-2-naphthyl, 3,5-dibromo-4-(4-bromobenzoyloxy)phenyl, 3,5-dibromo-4-(3,5-dinitrobenzoyloxy)phenyl, 3,5-dibromo-4(1-naphthoyloxy) phenyl, thiazolyl, oxazolyl, imidazolyl, pyrazolyl, triazolyl, oxadiazolyl, pryazinyl, etc. and their corresponding multivalent and fused ring configurations.

The mixtures of the present invention are made by the method disclosed in U.S. Pat. No. 4,499,165 to Molaire, which is incorporated herein by reference. Representative starting materials having a multicyclic aromatic nucleus and at least two functional (reactive) groups are selected from the following materials:

A. The phenylindan diols of J. C. Wilson, Research Disclosure 11833, February 1974, and J. C. Wilson, U.S. Pat. Nos. 3,803,096, 3,859,364 and 3,886,124 and the phenylindan diamines of J. C. Wilson, U.S. Pat. Nos. 3,897,253 and 3,915,939 having the structures:

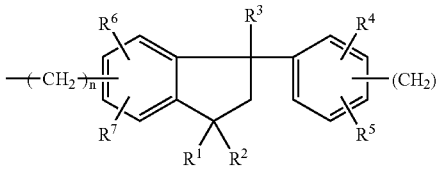

and

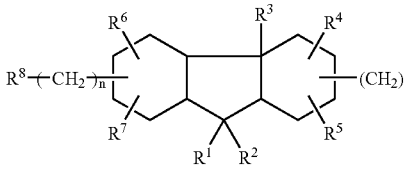

wherein $R^1$ and $R^3$ are independently selected from the group consisting of hydrogen and alkyl radicals of from 1 to 6 carbon atoms; $R^2$ is an alkyl radical of from 1 to 6 carbon atoms; $R^4$, $R^5$, $R^6$, and $R^7$ are independently selected from the group consisting of hydrogen, aryl radicals, halogen atoms, nitro radicals, cyano radicals, amino radicals, and alkoxy radicals; R is hydroxy or amino; and n is 0 or 1.

B. The 1,1'-spirobiindan diols and diamines of F. L. Hamb and J. C. Wilson, U.S. Pat. No. 3,725,070; and the 1-1'-spirobiindan (dicarboxylic acids) of Research Disclosure 9830, June, 1972 (anonymous), of the structure:

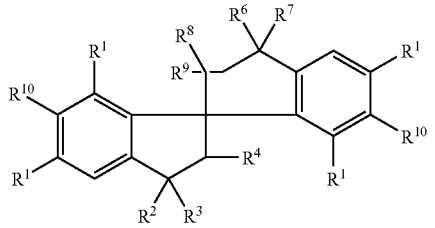

wherein each $R^1$ independently is selected from the group consisting of hydrogen atoms, or alkyl radicals having 1 to 12 carbon atoms; $R^2$, $R^3$, $R^4$, $R^5$, $R^6$, $R^7$, $R^8$, and $R^9$ are independently selected from the group consisting of hydrogen atoms and alkyl radicals of from 1 to 5 carbon atoms; $R^{10}$ is —OH, —$NH_2$, or —$OCH_2COOH$.

C. The 1,1'-spirobiindan-5,5'-diamines of J. C. Wilson, Research Disclosure 13117, March, 1975, with the structure:

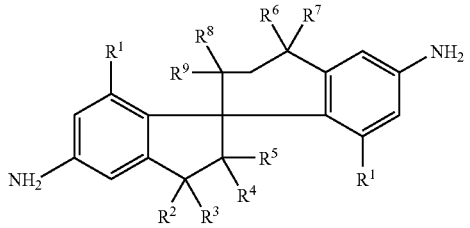

wherein each R.sup.1 is independently selected from hydrogen atoms and alkyl radicals of 1 to 12 carbon atoms; and $R^2$, $R^3$, $R^4$, $R^5$, $R^6$, $R^7$, $R^8$, and $R^9$ are independently selected from the group consisting of hydrogen atoms and alkyl radicals of from 1 to 5 carbon atoms.

D. The 2,2'-spirobichromans of F. L. Hamb and J. C. Wilson, U.S. Pat. No. 3,859,097 of the structure:

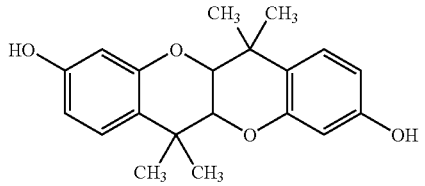

E. The 7,7-dimethyl-7H-dibenzo[c,h]xanthene diols of F. L. Hamb and J. C. Wilson, U.S. Pat. Nos. 3,859,254 and 3,902,904 of the structure:

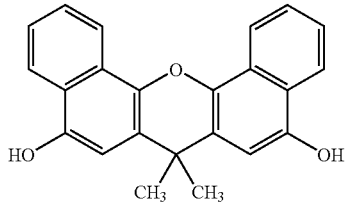

F. The 9,9-dimethylxanthene-3,6-bis(oxyacetic acids) of Research Disclosure 9830, June, 1972 (Anonymous) with the structure:

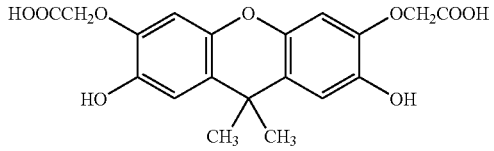

G. The xanthylium salts of J. C. Wilson, U.S. Pat. No. 3,856,751, with the structure:

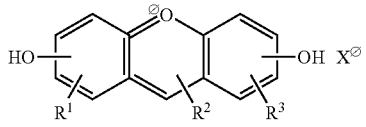

wherein $R^1$, $R^2$ and $R^3$ are hydrogen, alkyl, aryl, halogen, alkoxy, or cyano; and $X^{\theta}$ is an acid anion.

H. The 4,4-(3-phenyl-1-indanylidene)diphenols of J. C. Wilson, Research Disclosure 13101, March, 1975, with the structure:

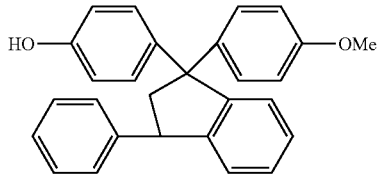

I. The 4,4-(hexahydro-4,7-methanoindan-5-ylidene) diphenols of M. A. Sandhu, Research Disclosure 13568, July, 1975, with the structure:

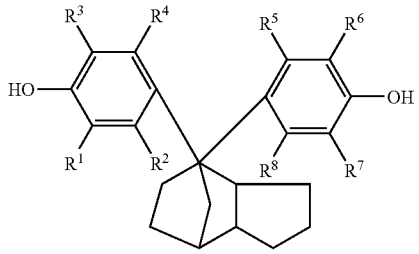

wherein $R^1$, $R^2$, $R^3$, $R^4$, $R^5$, $R^6$, $R^7$, and $R^8$ are independently hydrogen, halogen, cyano, alkyl of 1 to 8 carbon atoms, or alkoxy of 1 to 8 carbon atoms.

J. The bisphenols of T. L. Conklin and F. L. Hamb, Research Disclosure 12012, April, 1974, and the halogenated bisphenols of M. A. Sandhu, Research Disclosure 13569, July, 1975, with the structure:

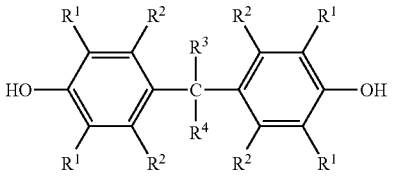

wherein each $R^1$ is hydrogen, halogen, preferably chloro or bromo, alkyl of 1 to 8 carbon atoms, or alkoxy of 1 to 8 carbons; each $R^2$ is hydrogen, alkyl of 1 to 8 carbon atoms or alkoxy of 1 to 8 carbon atoms; and $R^3$ and $R^4$ are alkyl of about 1 to 6 carbon atoms.

K. The sulfonyldibenzoic acids of M. A. Sandhu, Research Disclosure 14016, December, 1975, with the structure:

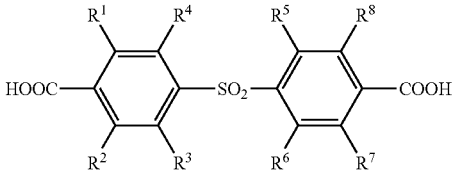

wherein each of $R^1$ through $R^8$ is independently from hydrogen, halogen, preferably chloro or bromo, and alkyl of about 1 to 4 carbon atoms.

L. The polycyclic norbornanes of Research Disclosure 9207, December, 1971 (Anonymous), with the structure:

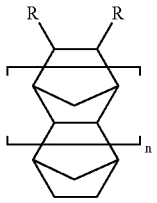

wherein n is 0 to 3 and R is —COOH or —$CH_2OH$.

M. The 1,2,3,4-tetrahydronaphthalenes of M. A. Sandhu, Research Disclosure 13570, July, 1975, with the structure:

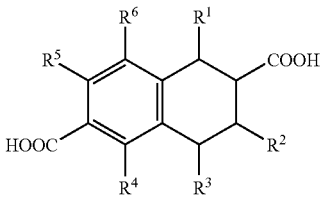

wherein each of $R^1$ through $R^6$ is independently selected from hydrogen, halogen or lower alkyl at 1 to 4 atoms.

Other useful polyfunctional compounds include commercially available bisphenols such as tetrabromophenolphthalein, tetrachlorophenolphthalein, tetrabromophenol blue, Eosin B, tetrabromocresol blue, hematoxylin, 4',5'-diodofluorescein, the polyhydroxy aromatic condensation product of pyrogallol and acetone, quercetin and derivatives thereof, the 9,9-bis(4-amino-3-benzoylphenyl)fluorene, 9,9-bis(4-aminophenyl)-10-anthrone and derivatives thereof reported in Macromolecules 14, p. 486-493 (1981), and other multifunctional molecules susceptible to quantitative condensation reaction to yield mixed esters, or mixed amides, or mixed imides, or mixed urethanes, or any other mixtures of organic materials that are noncrystallizable, and have glass-transition temperatures well above room temperature, i.e., above 50° C., preferably above 55° C.

Examples of monofunctional compounds that can be incorporated into the "nonpolymeric" amorphous glasses of this invention include:

1. Substituted benzene functionalized compounds of the structure:

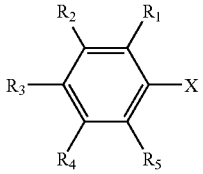

wherein $R_1$, $R_2$, $R_3$, $R^4$ and $R_5$ are independently selected from the group consisting of hydrogen, aryl radicals, halogen atoms, nitro radicals, cyano radicals, amino radicals and alkoxy radicals, and X is selected from the group consisting of primary or secondary amino radicals, hydroxy radicals, acid radicals, isocyanate radicals, etc.

2. Substituted phthalic anhydride compounds of the structure:

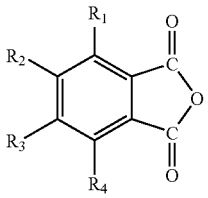

wherein $R_1$, $R_2$, $R_3$, $R^4$ are independently selected from the group consisting of hydrogen, aryl radicals, halogen atoms, nitro radicals, cyano radicals, and alkoxy radicals.

3. Aliphatic acids, alcohols, isocyanates, amines, and derivatives thereof. Aliphatic monofunctional compounds are particularly useful in controlling the glass transition temperature of the mixture within the range useful for toner applications.

4. Compounds having unsaturated polymerizable or crosslinkable groups such as acrylic acid, methacrylic acid and derivatives thereof, allyl alcohol, etc.

5. Any other monofunctional compounds susceptible to quantitative reactions amenable to the "nonpolymeric" amorphous glasses of this invention.

Some commercially available nonpolymeric glasses useful in the practice of this invention are the various derivatives of rosin available under many trade names. Examples are given in Table I.

TABLE I

Commercially Available Nonpolymeric Glasses

| Trade name* | Type | Softening Point, ° C. |
|---|---|---|
| "Ester Gum 8 BG" | Glycerol ester of wood rosin | 90 |
| "Pexalyn/A500" | Glycerol ester of wood rosin | 86 |

The above products are available from Hercules, Inc., Hercules Plaza, Wilmington, Del. 19894. For these amorphous materials, the softening point approximates the glass transition temperature. In any case, the glass transition temperatures for these materials are within the 50 to 120° C. range.

The encapsulated core/shell toners of this invention incorporate the monomeric glasses with or without the presence of waxes. The ratio of waxes to monomeric glasses depend on the melting point of the wax, the glass transition temperature of the glass mixture, and the physical characteristic of the shell.

The compatible compositions can be developed and optimized using technique such as differential scanning calorimetry, a well known compatibility assessment technique. The same technique can guide in determining optimum composition for blocking-free formulation.

The monomeric glasses chemistry will be chosen to match the chemistry of the shell material to optimize compatibility. For example an ester glass may fit a polyester shell better that a polyurethane shell.

The monomeric glasses can be can crosslinkable, via vinyl and acrylate groups, or via epoxy, isocyanate, blocked isocyanate chemistry.

The mixing of the monomeric glass material to the other ingredients of the shell of the encapsulated toners of this invention may be critical. In certain embodiments of this invention, it may be optimum to mix the glass mixture of this invention with the other ingredients of the core in dry form and avoid molecular mixing until the fusing step.

A variety of colorant materials selected from dyestuffs or pigments may be employed in the toner materials of the present invention. Such materials serve to color the toner and/or render it more visible. Of course, suitable toner materials having the appropriate charging characteristics can be prepared without the use of a colorant material where it is desired to have a developed image of low optical opacity. In those instances where it is desired to utilize a colorant, the colorants used, can, in principle, be selected from virtually any of the compounds mentioned in the Colour Index Volumes 1 and 2, Second Edition.

Included among the vast number of useful colorants would be such materials as Hansa Yellow G (C.I. 11680), Nigrosine Spirit soluble (C.I. 50415), Chromogen Black ET00 (C.I. 45170), Solvent Black 3 (C.I. 26150), Fuchsine N (C.I. 42510), C.I. Basic Blue 9 (C.I. 52015), etc. Carbon black also provides a useful colorant. The amount of colorant added may vary over a wide range, for example, from about 1 to about 20 percent of the weight of the binder. Particularly good results are obtained when the amount is from about 2 to about 10 percent. In certain instances, it may be desirable to omit the colorant, in which case the lower limit of concentration would be zero.

The amount of charge control agent which may be incorporated in the powdered toner compositions of this invention is preferably in the range from 0.2 to 5 weight percent of the toner composition.

The toners of this invention can be mixed with carrier particles to form dry developer compositions. The carrier particles which can be used with the present toners to form new developer compositions can be selected from a variety of materials. Suitable carrier vehicles useful in the invention include various nonmagnetic particles such as glass beads, crystals of inorganic salts such as sodium or potassium chloride, hard resin particles, metal particles, etc. In addition, magnetic carrier particles can be used in accordance with the invention. Suitable magnetic carrier particles are particles of ferromagnetic materials such as iron, cobalt, nickel, and alloys and mixtures thereof. Other useful materials which exhibit a net magnetic moment are the ferrimagnetic materials, including the ferrites as described in U.S. Pat. Nos. 3,795,618 to Kasper and 4,546,060 to Miskinis et al., which are incorporated herein by reference. Particularly preferred are strontium and barium ferrites. Other useful magnetic carriers are ferromagnetic particles overcoated with a thin layer of various film-forming resins, for example, the alkali-soluble carboxylated polymers described in U.S. Pat. No. 3,547,822 to Miller; U.S. Pat. No. 3,632,512 to Miller; U.S. Pat. No. 3,795,617 to McCabe, entitled "Electrographic Carrier Vehicle and Developer Composition—Case B;" Kasper et al., U.S. Ser. No. 236,584, now abandoned, filed Mar. 21, 1972, entitled "Electrographic Carrier Vehicle and Developer Composition—Case C;" and U.S. Pat. No. 3,795,618 to Kasper entitled, "Electrographic Carrier Vehicle and Developer Composition—Case D." Further useful resin coated magnetic carrier particles include carrier particles coated with various fluorocarbons such as polytetrafluoroethylene, polyvinylidene fluoride, and mixtures thereof including copolymers of vinylidene fluoride and tetrafluoroethylene.

A typical dry developer composition containing the above-described toner and a carrier vehicle generally comprises from about 1 to 20 percent by weight of particulate toner particles and from about 80 to about 99 percent by weight carrier particles. Typically, the carrier particles are larger than the toner particles. Conventional carrier particles have a particle size on the order of from about 2 to about 200 microns.

The shell of the core/shell toner particles of the instant invention is an amorphous matrix, having a glass transition temperature (Tg) of greater than about 50° C., preferably from about 55 to about 180° C., and more preferably from about 60 to about 90° C.

Examples of shell polymers include polyureas, polyamides, polyesters, polyurethanes, mixtures thereof, and polycondensation products of polyisocyanates and polyamines as illustrated in U.S. Pat. No. 4,877,706, entitled Single Component Cold Pressure Fixable Encapsulated Toner Compositions, the disclosure of which is totally incorporated herein by reference, and the like. The shell amounts are generally present in effective amounts of, for example, from about 5 to about 25 percent by weight of the toner, and have a thickness generally, for example, of less than about 5 microns, and more specifically from about 0.1 micron to about 3 microns. Other shell polymers, shell amounts, and thicknesses can be selected.

The shell forming monomer components present in the organic phase are generally comprised of diisocyanates, diacyl chloride, bischloroformate, together with appropriate polyfunctional crosslinking agents such as triisocyanate, triacyl chloride and other polyisocyanates. Illustrative examples of the shell monomer components include benzene diisocyanate, toluene diisocyanate, diphenylmethane diisocyanate, cyclohexane diisocyanate, hexane diisocyanate, adipoyl chloride, fumaryl chloride, suberoyl chloride, succinyl chloride, phthaloyl chloride, isophthaloyl chloride, terephthaloyl chloride, ethylene glycol bischloroformate, diethylene glycol bischloroformate, and the like. The water-soluble, shell forming monomer components in the aqueous phase can be a polyamine or a polyol including bisphenols. Illustrative examples of water soluble shell monomers include ethylenediamine, triethylenediamine, diaminotoluene, diaminopyridine, bis(aminopropyl)piperazine, bisphenol A, bisphenol Z, and the like. When desired, a water soluble crosslinking agent, such as triamine or triol, can also be added to improve the mechanical strength of the polymeric shell structure. Shell examples are detailed in U.S. Pat. No. 4,877,706, the disclosure of which is totally incorporated herein by reference.

Alternatively, the toners of the present invention can be used in a single component developer, i.e., with no carrier particles.

The toner and developer compositions of this invention can be used in a variety of ways to develop electrostatic charge patterns or latent images. Such developable charge patterns can be prepared by a number of means and be carried for example, on a light sensitive photoconductive element or a non-light sensitive dielectric-surfaced element such as an insulator-coated conductive sheet. One suitable development technique involves cascading the developer composition across the electrostatic charge pattern, while another technique involves applying toner particles from a magnetic brush. This latter technique involves the use of a magnetically attractable carrier vehicle in forming the developer composition. After imagewise deposition of the toner particles, the image can be fixed, e.g., by heating the toner to cause it to fuse to the substrate carrying the toner. If desired, the unfused image can be transferred to a receiver such as a blank sheet of copy paper and then fused to form a permanent image. The examples below show the preparation of two monomeric glass mixtures with properties suitable for core/shell toner applications.

Preparation of Monomeric Glass Mixtures

Preparation A 4,4'-isonropylidenebis(2,6-dichlorophenylene) dimethacrylate

In a 100-mL, three-neck, round-bottomed flask, 51.25 g (0.14 mole) of 4,4'-isopropylidenebis(2,6-dichlorophenol) were dissolved in 200 mL of 1,2-dichloroethane. An amount of 29.5 g (0.29 mole) triethylamine was added and the mixture stirred magnetically. A quantity of 29.27 g (0.28 mole) of methacryloyl chloride was dissolved in 100 mL of 1,2-dichloroethane and added drop wise to the mixture in the flask. After complete addition and 3 hr of stirring, the triethylamine hydrochloride salt formed was filtered and the solution extracted with dilute sodium hydroxide in the cold, dilute hydrochloric acid, then given several water washes. The solution was dried over magnesium sulfate before evaporation of the solvent. The solid obtained was recrystallized from hexane. NMR and IR confirmed the structure of the compound and the absence of free hydroxyl groups; mp: 135° C.; Tg: 33-35° C.

Preparation B 4,4'-isopropylidenebis(2,6-dichlorophenylene) acrylate:methacrylate 50:50

This monomer was prepared using the apparatus and procedure of Preparation A, with 51.25 g (0.14 mole) of 4,4'-isopropylidenebis(2,6-dichlorophenol), 14.64 g (0.14 mole) of methacryloyl chloride, 12.67 (0.14 mole) of acryloyl chloride and 29.5 g (0.29 mole) of triethylamine. The product was recrystallized from hexane; Tm: 103° C.; Tg: 28-29° C.

Preparation C 4,4'-isopropylidenebis(2,6-dimethylphenylene) dimethacrylate

This monomer was prepared using the apparatus and procedure of Preparation A from 18 g (0.063 mole) of 4,4'-isopropylidenebis(2,6-dimethylphenol), 13.23 g (0.126 mole) of methacryloyl chloride and 13.4 g of tri ethyl amine.

Preparation D 4,4'-isopropylidenebis(2,6-dichlorophenylene) methacrylate:acetate 50:50

The monomer was prepared using the apparatus and procedure of Preparation A from 51.25 g (0.14 mole) of 4,4'-isopropylidenebis(2,6-dichlorophenol), 14.64 g (0.14 mole) of methacryloyl chloride, 10.99 g (0.14 mole) of acetyl chloride and 18 g of $Et_3$ N. The product was recrystallized from hexane. Although the monomeric materials of preparation A, B, C, and D show crystallinity character, mixing at least any two of these materials produce a amorphous, non-crystallazable mixture.

Preparation E

Amorphous mixture from 4,',4'-[benzo(c)furan-3-on-1-ylidene]bis(2,6-dibromophenol) (45 mole %) and 4,4'-isopropylidenebis(2,6-dibromophenol) (55 mole %) condensed with acryloyl chloride (50 mole %) and methacryloyl chloride (50 mole %)

The following materials were employed: 4,4'-[benzo(c) furan-3-on-1-ylidene]bis(2,6-dibromophenol), 39.37 g (0.0621 mole); 4,4'-isopropylidenebis(2,6-dibromophenol), 41.28 g (0.0759 mole); acryloyl chloride, 12.50 g (0.138 mole); methacryloyl chloride, 14.43 g (0.138 mole); and triethylamine, 30 g (0.297 mole).

The required amounts of the two bisphenols, acryloyl chloride and methacryloyl chloride were dissolved in approximately 600 mL of dichloromethane in a three-neck, round-bottomed flask. The solution was cooled to 0° C. using an ice-water mixture. A condenser fitted with a drying tube and a positive-pressure nitrogen system was used to keep moisture out of the reaction vessel.

The triethylamine dissolved in 100 mL of dichloromethane was added drop wise to the stirred solution in the reaction flask. After complete addition of the triethylamine, an additional one-tenth molar fraction of the stoichiomtric amount of acryloyl chloride was added to ensure complete reaction. The reaction was allowed to continue for 3 additional hours, at which time the precipitated salt was filtered off. The solution was subjected to the following extraction sequence.

(a) Two dilute sodium hydroxide solution washes (2% cold);

(b) two dilute hydrochloric acid solution washes (4%);

(c) two distilled water washes.

The dichloromethane solution was then dried over magnesium sulfate. Hydroquinone (0.5 wt % of the starting bisphenol) was dissolved in 200 mL of ethanol and added to the solution.

Substantially all of the solvent was stripped off under vacuum at approximately 70° C.

To the dried amorphous monomer, 100 mL of ethanol and 25 mL of acetone were added. After thorough mixing, any remaining solid was filtered.

The solution was then added drop wise to 4 liters of distilled water in a Warning blender for precipitation of the product.

The precipitation can be repeated as many times as deemed necessary for adequate purification. The isolated monomer was air-dried at ambient temperature to yield a very fine powder. Tg=59° C. This mixture shows no crystallinity at all.

The invention has been described in detail with particular reference to certain preferred embodiments thereof, but it will be understood that variations and modifications can be effected within the spirit and scope of the invention.

The invention claimed is:

1. An electrostatographic toner comprising a core material comprising an amorphous glass composition comprising a mixture of at least two nonpolymeric compounds each independently corresponding to the structure $$(R^1Y^1)_p[(Z^1Y^2)_mR^2Y^3]_nZ^2Y^4R^3$$

wherein m is zero or one; n is the number of recurring units in the compound, and is zero up to, but not including, an integer at which said compound starts to become a polymer; p is an integer of from one to eight;

each $R^1$ and $R^3$ is independently a monovalent aliphatic or cycloaliphatic hydrocarbon group having up to 20 carbon atoms, an aromatic group or a multicyclic aromatic nucleus;

$R^2$, $Z^1$ and $Z^2$ each independently represent multivalent aliphatic or cycloaliphatic hydrocarbon groups having up to 20 carbon atoms or an aromatic group;

$Y^1$, $Y^2$, $Y^3$ and $Y^4$ each independently represents one or more linking groups such as esters (—COO—), amides (—CONH—), urethanes (—NHCOO—), imides

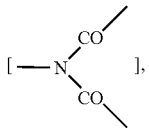

nitrilomethyleneoxys

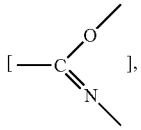

nitrilomethyleneiminos

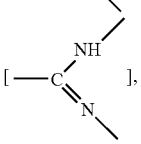

-continued nitrilomethylenethios

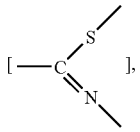

1, 3, 4-triazol-2, 5-ylenes

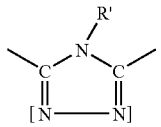

wherein $R^1$ represents alkyl of 1-6 carbon atoms, hydroxyl, amino or aryl, and 1,3,4-oxadiazol-2,5-ylenes

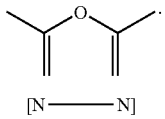

wherein the glass transition temperature of the at least two nonpolymeric compounds is from 50 to 120° C.; and a shell comprising an amorphous matrix, having a glass transition temperature (Tg) of greater than about 50° C.

2. The toner of claim 1 wherein the core further comprises waxes.

3. The toner of claim 1 wherein the core further comprises colorants.

4. The toner of claim 1 wherein the core further comprises charge control agents.

5. The toner of claim 1 wherein at least two nonpolymeric compounds are crosslinkable.

6. The toner of claim 1 wherein at the shell comprises polymers selected from the group consisting of polyureas, polyamides, polyesters, polyurethanes, polycondensation products of polyisocyanates and polyamines and mixtures thereof.

7. The toner of claim 1 wherein the shell comprises from about 5 to about 25 percent by weight of the toner.

8. The toner of claim 1 wherein the shell comprises a thickness of less than 5 microns.

9. An electrostatographic developer comprising:

toner particles comprising a core material comprising an amorphous glass composition comprising a mixture of at least two nonpolymeric compounds each independently corresponding to the structure $$(R^1Y^1)_p[(Z^1Y^2)_mR^2Y^3]_nZ^2Y^4R^3$$

wherein m is zero or one; n is the number of recurring units in the compound, and is zero up to, but not including, an integer at which said compound starts to become a polymer; p is an integer of from one to eight;

each $R^1$ and $R^3$ is independently a monovalent aliphatic or cycloaliphatic hydrocarbon group having up to 20 carbon atoms, an aromatic group or a multicyclic aromatic nucleus;

$R^2$, $Z^1$ and $Z^2$ each independently represent multivalent aliphatic or cycloaliphatic hydrocarbon groups having up to 20 carbon atoms or an aromatic group;

$Y^1$, $Y^2$, $Y^3$ and $Y^4$ each independently represents one or more linking groups such as esters (—COO—), amides (—CONH—), urethanes (NHCOO—), imides

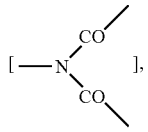

nitrilomethyleneoxys

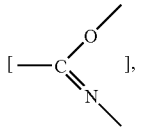

nitrilomethyleneiminos

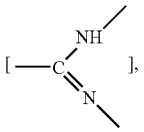

nitrilomethylenethios

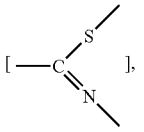

-continued 1, 3, 4-triazol-2, 5-ylenes

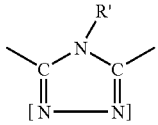

wherein $R^1$ represents alkyl of 1-6 carbon atoms, hydroxyl, amino or aryl, and 1,3,4-oxadiazol-2,5-ylenes

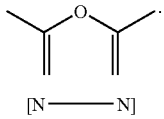

wherein the glass transition temperature of the at least two nonpolymeric compounds is from 50 to 120° C.; and a shell comprising an amorphous matrix, having a glass transition temperature (Tg) of greater than about 50° C.; and carrier particles.

* * * * *